US011059710B2

(12) United States Patent
Naaber

(10) Patent No.: US 11,059,710 B2
(45) Date of Patent: Jul. 13, 2021

(54) ROTARY-TYPE CAPPING MACHINE

(71) Applicant: KHS GmbH, Dortmund (DE)

(72) Inventor: Matthias Naaber, Bretzenheim (DE)

(73) Assignee: KHS GmbH, Dortmund (DE)

( * ) Notice: Subject to any disclaimer, the term of this patent is extended or adjusted under 35 U.S.C. 154(b) by 37 days.

(21) Appl. No.: 16/617,318

(22) PCT Filed: May 29, 2018

(86) PCT No.: PCT/EP2018/064006
§ 371 (c)(1),
(2) Date: Nov. 26, 2019

(87) PCT Pub. No.: WO2018/219908
PCT Pub. Date: Dec. 6, 2018

(65) Prior Publication Data

US 2020/0262691 A1 Aug. 20, 2020

(30) Foreign Application Priority Data

Jun. 2, 2017 (DE) ..... 102017112218.4

(51) Int. Cl.
*B67B 3/20* (2006.01)

(52) U.S. Cl.
CPC ..... *B67B 3/2033* (2013.01); *B67B 3/2066* (2013.01)

(58) Field of Classification Search
CPC ..... B67B 3/10; B67B 3/20; B67B 3/2013; B67B 3/2033; B67B 3/2066; B67B 3/2053; B67B 3/206
USPC ..... 53/75, 167, 285, 287, 303, 308, 317, 53/329.2, 331.5, 490
See application file for complete search history.

(56) References Cited

U.S. PATENT DOCUMENTS 2,507,427 A * 5/1950 Underwood ..... B67B 3/18 53/340
5,419,094 A * 5/1995 Vander Bush, Jr. ..... B67B 3/2033 53/317

(Continued)

FOREIGN PATENT DOCUMENTS

EP 0690020 1/1996
JP 08324689 A * 10/1996 ..... B67B 3/20

(Continued)

*Primary Examiner* — Hemant Desai
*Assistant Examiner* — Jacob A Smith
(74) *Attorney, Agent, or Firm* — Occhiuti & Rohlicek LLP

(57) ABSTRACT

A rotary capping machine for containers with screw caps includes a central and fixedly mounted support around which a rotary carrier having capping arrangements can be driven to rotate rotation by a first motor. The capping arrangements have capping tools that can be lifted and lowered and that can be rotated by a second motor. Each has, on its underside, a capping head for receiving screw caps. The support central includes a bottom support, the top end of which is connected to a middle support that forms a bearing section and that has a rotary bearing. The middle support releasably connects to a top support, which releasably connects to a head plate. The drive gear's rotation axis and that of the first motor are parallel to the machine axis. The drive gear meshes with a crown gear formed on the rotary carrier. The second motor's drive gear is parallel to the machine axis and meshes with a crown gear formed on the control element.

20 Claims, 3 Drawing Sheets

(56) References Cited

U.S. PATENT DOCUMENTS 6,679,026 B1 * 1/2004 Cirio ..... B67B 3/2033 53/317
9,815,207 B2 * 11/2017 Ronchi ..... B25J 15/10
2002/0178689 A1 * 12/2002 Nervo ..... B67B 1/03 53/167
2006/0272284 A1 * 12/2006 Galimberti ..... B67B 3/2033 53/75
2009/0145083 A1 * 6/2009 Dumargue ..... B67B 3/2033 53/285
2010/0049357 A1 * 2/2010 Weil ..... B67B 3/26 700/213
2010/0077706 A1 * 4/2010 Cirio ..... B67B 3/2033 53/490
2010/0192514 A1 * 8/2010 Zanini ..... B67B 3/28 53/303
2010/0205904 A1 * 8/2010 Zanini ..... B67B 3/22 53/287
2010/0307110 A1 * 12/2010 Wilhelm ..... B67B 3/12 53/329.2
2011/0131923 A1 * 6/2011 Schonfelder ..... B67B 3/28 53/287
2012/0017539 A1 * 1/2012 Neufeld ..... H02K 16/00 53/285
2012/0079792 A1 * 4/2012 Kampmann ..... B67B 3/2013 53/285
2012/0186194 A1 * 7/2012 Schlieper ..... B67B 3/18 53/317
2014/0096482 A1 * 4/2014 Singur ..... B67B 3/00 53/287
2015/0375980 A1 * 12/2015 Naaber ..... B67B 3/2033 53/317
2020/0131014 A1 * 4/2020 Boscaro ..... B67B 3/2013

FOREIGN PATENT DOCUMENTS

JP H08324689 * 12/1996 ..... B67B 3/2033
WO 2012/163449 12/2012
WO WO-2014071467 A1 * 5/2014 ..... B67B 3/28

* cited by examiner

ROTARY-TYPE CAPPING MACHINE

RELATED APPLICATIONS

This application is the national stage of international application PCT\EP2018\064006, filed on May 29, 2018, which claims the benefit of the Jun. 2, 2017 priority date of German application DE 10-2017 112-218.4, the contents of which are herein incorporated by reference.

FIELD OF INVENTION

The invention relates to capping machines for screw caps and in particular, to rotary capping machines.

BACKGROUND

Capping machines place caps on containers. Such caps include screw caps that are rotated while being placed on a container.

In the course of routine maintenance or repair, it sometimes becomes necessary to dismantle a capping machine. However, known capping machines are difficult to dismantle. It is also difficult to replace the various components of known capping machines.

SUMMARY

An object of the invention is that of providing a capping machine that is compact and that can easily be dismantled from above.

The present invention relates to a rotary capping machine for capping containers with screw caps. Such a machine typically includes a central support that is fixedly mounted. Around the central support is a rotary carrier that has capping arrangements. A first motor drives these capping arrangements.

The capping arrangements include capping tools that can be lifted and lowered. A second motor rotates the capping tools. The underside of each capping tool has a capping head for receiving screw caps.

Typically, the motors are electric motors. However, other kinds of motors can be used.

In one aspect, the invention features a capping machine having a support element that comprises a bottom support that connects, at a top end thereof, to a middle support, which forms a bearing section and comprises at least one rotary bearing for the rotary carrier. In some embodiments, the bottom support is as an extended column with a circular or a polygonal cross-section. In some of these embodiments, the bottom support carries, on and upper side thereof, a flange, screwed to which is the middle support, which forms the bearing section.

The middle support connects to a top support in such a way that it can easily be released from the top support. The top support, meanwhile, connects to the head plate in such a way that it is easily released from the head plate. This makes it possible to dismantle the capping machine successively from above, starting from the head plate. This configuration also means that that space that is needed to carry out the dismantling operation can be kept small. In fact, this space need not be much higher than the top support.

The first motor's drive gear rotates about an axis that is parallel to the machine axis. The drive gear meshes with a crown gear formed on the rotary carrier. As a result, it is easy to transfer power from the first motor to the rotary carrier.

The second motor's drive-gear wheel also rotates about an axis that is parallel to the machine axis. This second drive-gear wheel meshes with a second crown gear formed at the control element. Accordingly, the drive components run parallel to the machine axis. As a result, upon dismantling the capping machine, it is a simple matter to dismantle the drive components. The dismantling operation is made easier by several factors, including the fact that as drive elements engaging with one another, a drive gear wheel of a drive or motor interacts with a crown gear of the rotary carrier or control element. These drive components are easily and completely separable.

A capping machine as disclosed and claimed herein is particularly useful for capping screw cap bottles and in particular, bottles made of glass or PET. The capping machine is easily manufactured to be compact, easily dismantled, and easily reassembled. The drives' reciprocally interacting drive components are easily detachable and easily reconnected. Individual modules, which are those that are more prone to wear, can therefore be easily and rapidly replaced.

Preferably, at least one of the motors has a shaft guide that extends parallel to the machine axis. This means that dismantling the head plate or the top support leads automatically to dismantling the reciprocally interacting drive components. The shaft guide projects as far as the middle support. It uses the drive gear wheel at its end to drive a corresponding crown gear.

Some embodiments feature a head plate that is connected to the top support in such a way that it can easily be released from the top support. This means that the capping machine can easily be dismantled from above, and in particular, from the head plate.

In a preferred embodiment, the middle support is secured to the bottom support in such a way that it can be released. Among these are embodiments in which the middle support comprises the bearing section for the rotary bearing and the bottom support is an extended support column. Such embodiments result in a capping machine that is easily dismantled from above without having to dismantle the bottom support. For example, such embodiments can be dismantled starting as far as a vertical level of the rotary bearing or the container support. Since the bottom support element is a relatively long support column, the space required for assembly and disassembly of the capping machine is less than that required in known capping machines.

Some embodiments feature top, middle, and bottom supports that detachably connect to the head plate and to each other by a releasable connection. For example, in some embodiments, screws connect these components. This arrangement promotes the ability to dismantle the different support elements of the capping machine and therefore also of individual drive components. These drive components include drive shafts, shaft guides, drive gear wheels, and crown gears that interact with the drive gear wheels of the motors or drives. This is particularly useful because these components are most prone to wear.

The arrangement of the rotary bearings for the bearing support and preferably also of the control element at the middle support makes it easy to replace the rotary bearings for these components. This arrangement is particularly advantageous because these components are also prone to wear.

In some embodiments, the control element is mounted so as to be able to rotate. Among these are embodiments in which the control element is mounted on the top support element, those in which it is mounted on the rotary carrier, and those in which it is mounted on both. In either case, this configuration results in the efficient formation of a bearing arrangement without substantial lifting forces.

In some embodiments, the control element is mounted at or on the rotary carrier. An advantage of this is that only the middle support needs to support the first rotary bearing for the rotary carrier. No other rotary bearing needs to be supported by the bottom, middle, or top supports. The entire bearing arrangement is therefore at the middle support or bearing section. As a result, the rotary bearings for the rotary carrier and the rotary bearing for the control element are arranged on one component. This makes it easier to replace them. I In a preferred embodiment, the top support surrounds an inner space that contains the machine axis. This inner space contains most, if not all, of the first motor's drive gear wheel. The first motor's drive shaft, or shaft guide can therefore extend inside this inner space. As a result, the entire vertical section, including that which contains the machine axis, can be provided with the drive components. This means that the capping machine can be quite compact. Because the first motor's drive shaft has been arranged the inner space, it becomes easy to separate the two drive shafts, namely that of the rotary carrier's motor and that of the control element's motor.

In a preferred embodiment, in which the control element has an outer crown gear wheel that interacts with an outer tooth arrangement of the capping tools, the first motor's drive gear wheel is arranged in the inner space and the second motor's drive gear wheel is arranged in the ring-shaped space between the top support and the control element's outer crown gear wheel.

In general, the capping heads that are held at the capping tools operate at some revolution speed and the capping machine, and in particular, the rotary carrier, operates at some rotation speed. In preferred embodiments, the revolution speed and the rotation speeds are adjustable independently of each other. One way to achieve such independent adjustment is to configure the capping tools' rotation drive in such a way that the second motor's drive gear wheel interacts with the control element's crown gear wheel and to also provide the control element with an outer crown gear wheel or outer tooth arrangement that meshes with the capping tools' outer tooth arrangement at the capping arrangements.

Since the first motor's drive gear wheel is inside the top support's inner space the top support should be open at least over a sector. Thus, in preferred embodiments, the top support opens over a machine sector in which the first motor's drive gear wheel meshes with the rotary carrier's crown gear. This enables the first motor's drive gear wheel to interact with a crown gear wheel on the rotary support at that sector.

In some embodiments, this is made possible by having the top support element be formed by parallel support braces. These braces are preferably arranged to surround the machine axis and to all be at the same distance from the machine axis. In such embodiments, it is preferable that the first motor's shaft guide also extend inside the inner space.

The second motor rotates the control element. The control element then carries out a reciprocal interaction with the capping tools' outer tooth arrangement. A runner on the upper side of the capping tools enables the capping tools to move up and down. These capping tools carry the capping heads, which carry the screw caps. The runner runs along the capping machine's control link. As the runner does so, a control curve deflects it up and down. This allows the capping tools, and hence the capping heads, to reciprocate up and down in addition to rotating.

In some embodiments, the bottom support connects below the rotary support or below the container carrier. One way to carry out the connection is using a screw flange. Among these are embodiments; a gap of between five and thirty centimeters separates the bottom support from the rotary support or container carrier.

A particular advantage of the foregoing embodiments is that the height of the capping machine that is to be dismantled extends only over the vertical section from the head plate as far as the rotary bearing. It does not include the support column that forms the bottom support. This means that the bottom support can be made quite long without adversely impacting the space required for dismantling.

In a further embodiment, both motors are secured to the head plate. The motors' shaft guides extend vertically along an axis parallel to the machine axis towards their respective drive gear wheels. As a result, the drive components run parallel to the machine axis. This means that, when dismantling the capping machine, the drive components can easily be dismantled from above.

In a preferred embodiment, the second motor's shaft guide or its drive gear wheel extends into the ring-shaped region between the top support and the capping arrangements. In these embodiments, the interacting drive components of the first and second motors are arranged at different radial distances from the machine axis. As a result, they can easily be detached from one another.

The invention further includes combinations of the foregoing embodiments.

As used herein, the following pairs of terms are to be considered synonymous: "motor" and "drive"; "drive gear wheel" and "drive pinion"; "container" and "bottle"; and "control element" and drive element."

BRIEF DESCRIPTION OF THE DRAWINGS

The invention is described hereinafter on the basis of the schematic drawings, in which.

DETAILED DESCRIPTION

Figure 1:
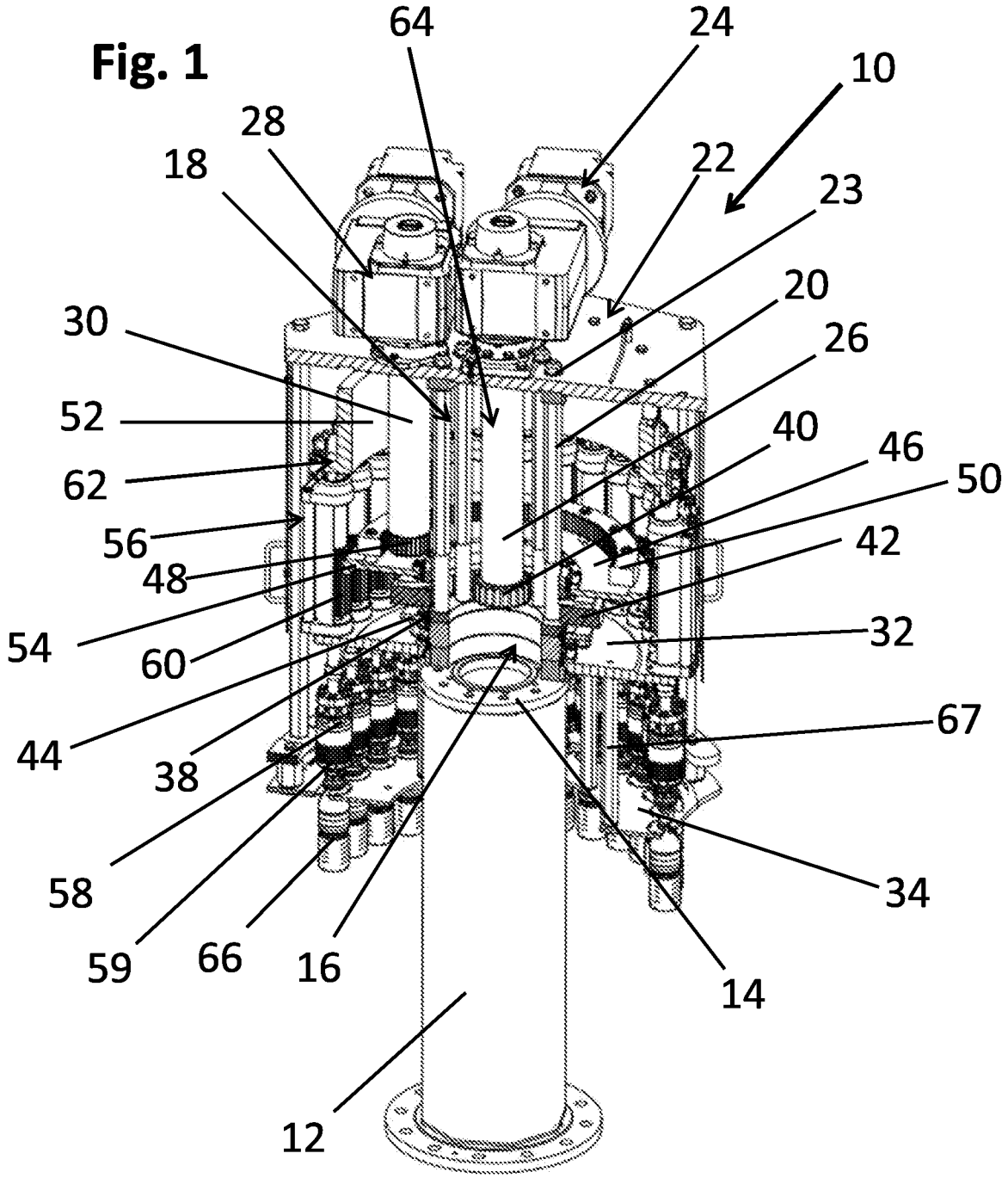
FIG. 1 is a perspective partially sectional view of a capping machine with an inner tooth arrangement.

FIG. 1 shows a capping machine 10 having a bottom support 12 that extends along a machine axis. In the illustrated embodiment, the bottom support 12 is implemented as a polygonal support column having a screw flange 14 at an upper end thereof.

The capping machine 10 also includes a middle support 16 that is screwed onto the screw flange 14. An outer circumferential surface of the middle support 16 features a first rotary bearing 38 for a rotary support 32. An outer surface of the rotary support 32 carries capping arrangements 56.

A top support 18 that is screwed onto the middle support includes vertical support braces 20 that are spaced apart from each other equidistantly around the machine axis. The vertical support braces 20 delimit an inner space 64 through which the machine axis extends. Securing screws 23 screw an upper end of the vertical support braces 20 to a head plate 22. The head plate 22 carries a first motor 24, a shaft guide 26 of which extends through the inner space 64.

A drive gear wheel 40 arranged under the first motor's shaft guide 26 meshes with a crown gear-wheel 42. The crown gear wheel 42 securely connects to the rotary support 32. This prevents relative rotation between the crown gear wheel 42 and the rotary support 32. As a result, the first motor 24, the rotary bearing 32, and the capping arrangements 56 rotate at an adjustable speed.

The head plate 22 also carries a second motor 28, a shaft guide 30 of which extends downward to the second motor's drive gear wheel 48. This drive gear wheel 48 meshes with another crown gear wheel 50 at a control element 46.

Figure 3:
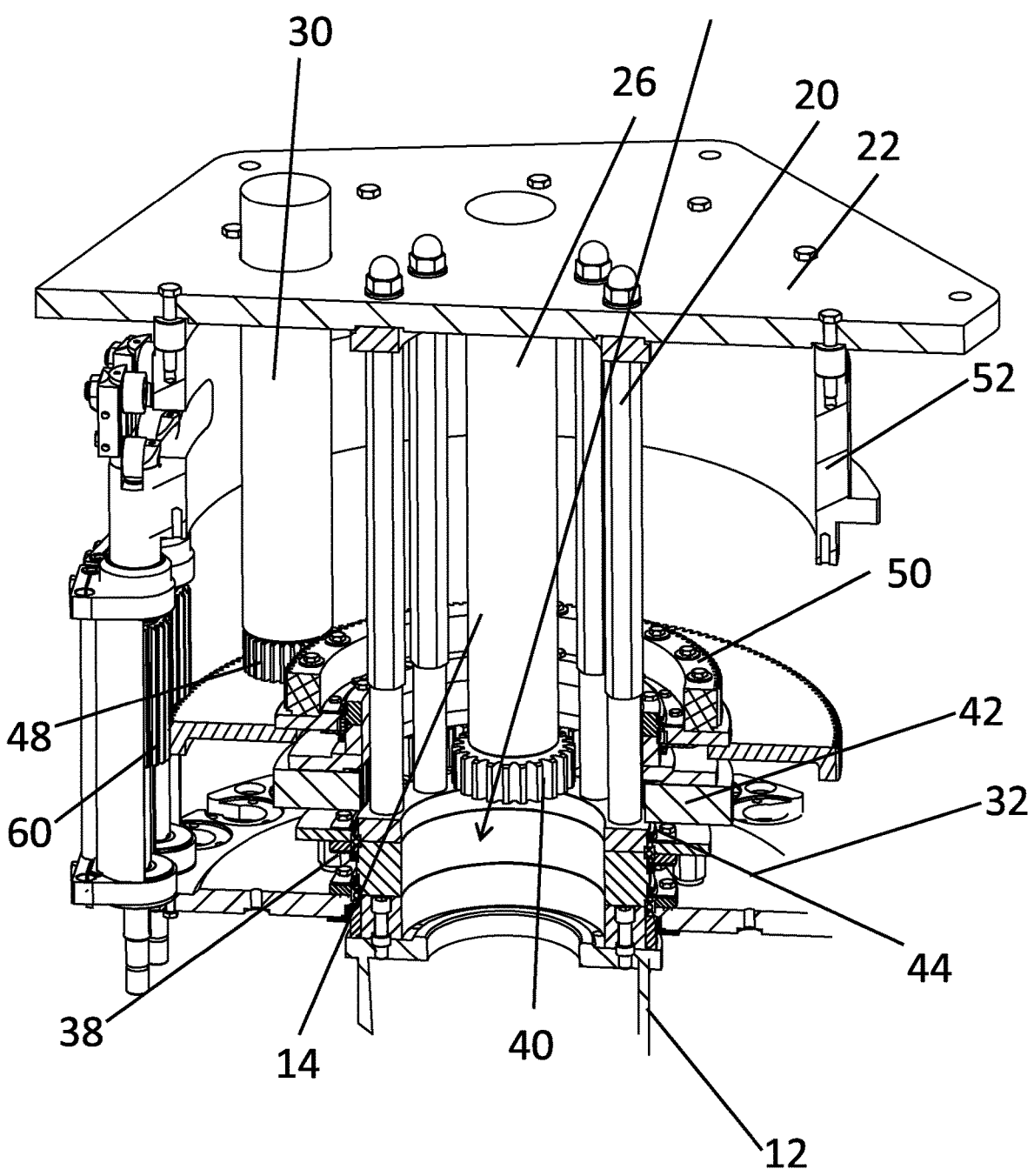
FIG. 3 is a perspective view of an alternative capping machine with an outer tooth arrangement.

In the illustrated embodiment, the crown gear wheel 50 is an inner crown gear. However, in some embodiments, the crown gear wheel 50 is an outer crown gear. In such embodiments, the shaft guide 30 and the drive gear wheel 48 are arranged to engage the radially outward surface of the crown gear wheel 50, as shown in FIG. 3.

A second rotary bearing 44 mounts the control element 46 on the rotary support 32. As a result, the control element 46 rotates independently of the rotary support 32 even though it is mounted to the rotary support 32.

The control element 46 includes an outer crown gear wheel 54 that meshes with an outer tooth arrangement 60 at capping tools 58 of the capping arrangements 56. As a result, the second motor 28 causes controlled rotation of the capping tools 58, which then transfer this controlled rotation to capping heads 59 arranged at the bottom ends of the capping tools 58. These capping heads 59 carry screw caps.

Vertical braces connect the rotary bearing 32 to a container carrier 34. At its outer surface, the container carrier 34 comprises container receivers 35 that receive containers 66. The container carrier 34 holds the containers 66 beneath corresponding capping heads 59.

Each capping tool 58 has a top end that connects to a runner 62. The runner 62 runs along a control curve of a control link 52. In some embodiments, the control link 52 connects to the head plate 22. In others it connects to the vertical support braces 20. In yet others, it connects to both. In each case, the connection is a secure connection that prevents relative rotation between the control link and whatever it connects to. As a result, the capping tools 58 and the capping heads 59 undergo defined vertical motion. This permits them to both place screw caps onto containers 66 and to also screw them tightly, all in a single capping procedure.

As a result of the foregoing construction, it is a simple matter to dismantle the capping machine 10 from the head plate 22. Once the head plate 22 and either the top support 18 or the vertical support braces 20 have been dismantled, it is easy to then dismantle the first motor's shaft guide 26, the second motor's shaft guide 30, the first motor's drive gear wheel 40, and the second motor's drive gear wheel 48 from the rotary support 32 and the control element 46. This makes it easy to dismantle the capping machine 10 and to replace its individual components.

The screw flange 14 is vertically offset from the rotary support 32 by no more than about thirty centimeters. As a result, when the capping machine 10 is being dismantled, it is not necessary to provide the rather large space that would otherwise be needed to accommodate the length of the bottom support 12.

An advantage of the foregoing construction arises because all major components of the capping machine 10 can be dismantled from the head plate 22 as far as the flange 14. It is also unnecessary to dismantle the bottom support 12 to access the major components of the capping machine 10.

Figure 2:
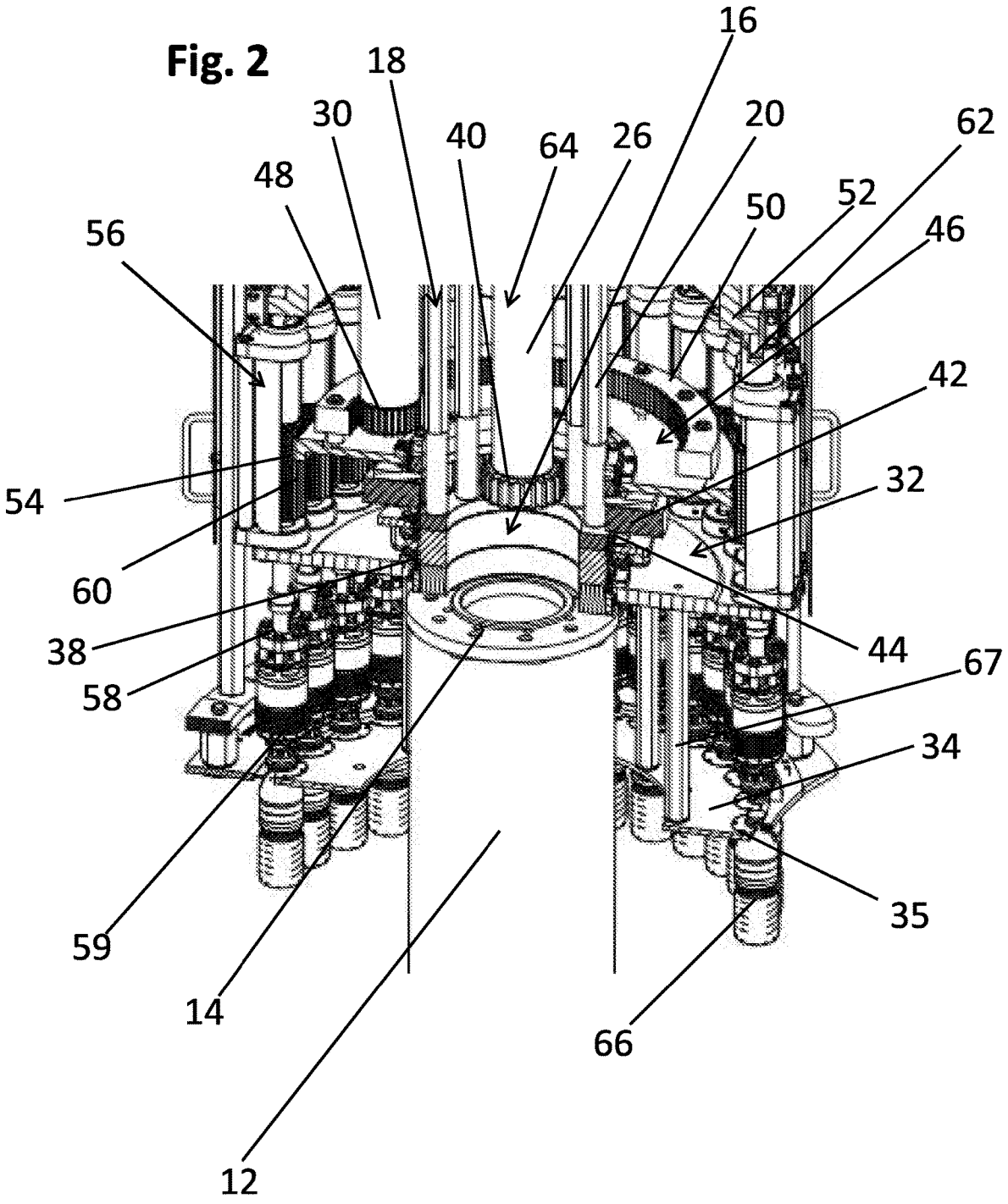
FIG. 2 is an enlarged section in the middle region of the capping machine from FIG. 1.

An alternative embodiment, shown in FIG. 3, is similar to that shown in FIGS. 1 and 2 but with the notable exception of the drive being provided by the second motor 28.

In the embodiment shown in FIG. 3, the head plate 22 carries a second motor 28, which has been omitted from the figure for clarity. The second motor's shaft guide 30 extends down to the second motor's drive gear wheel 48. The second motor's drive gear wheel 48 meshes with a crown gear wheel 50 at the control element 46. In the illustrated embodiment, the crown gear wheel's teeth face radially outward. Therefore, the shaft guide 30 and the drive gear wheel 48 are both disposed outside the circle defined by the crown-gear wheel 50 to engage these teeth.

The invention claimed is:

1. An apparatus comprising a capping machine for screwing a screw-closure onto a container, said capping machine being a rotary capping machine that rotates about a machine axis, said capping machine comprising a support element, said support element being a central and fixedly-mounted support element that is configured to be rotated by a first motor and around which a rotary support having capping arrangements is arranged, each of said capping arrangements comprising a capping tool that is configured to be raised and lowered and to be rotated by a second motor that is controlled independently of said first motor, each of said capping tools having, on an underside thereof, a capping head for receiving screw closures, said support element comprising a carrier that comprises a bottom support, wherein a top end of said carrier connects to a middle support that forms a bearing section that comprises a first rotary bearing and a rotary support, wherein said middle support is configured to transition between being connected to a top support and being released from said top support, a control element mounted so as to rotate about said machine axis and configured to be rotated by said second motor, wherein said second motor interacts with said capping tools to transfer controlled rotation to said capping heads, a head plate that connects to said support element, wherein said top support is configured to transition between being connected to said head plate and being released from said head plate, and a control link, said control link being a non-rotating control link that is mounted on at least one of said support element and said head plate for raising and lowering said capping heads during rotation of said capping arrangements about said support element, wherein said first and second motors comprise corresponding first and second drive-gear wheels, wherein said first drive-gear wheel rotates about an axis of rotation that is parallel to said machine axis and meshes with a first crown-gear wheel that is arranged at said rotary support and wherein said second drive-gear wheel is oriented parallel to said machine axis and meshes with a second crown-gear wheel that is formed on said control element, wherein said top support encloses an inner space that contains said machine axis and wherein a greater part of said first drive-gear wheel is arranged inside said inner space, and wherein said top support is open over a machine sector in which said first drive-gear wheel meshes with said crown-gear wheel of said rotary support.

2. The apparatus of claim 1, further comprising a shaft guide that extends parallel to said machine axis, said shaft guide being a shaft guide of one of said first and second motors.

3. The apparatus of claim 1, further comprising a flange, wherein, as a result of said flange, said middle support transitions between being secured to said bottom support and being released from said bottom support.

4. The apparatus of claim 1, wherein said top support is detachable from said heat plate, said middle support is detachable from said top support, and said bottom support is detachable from said middle support.

5. The apparatus of claim 1, wherein said control element is mounted at one of said top support and said rotary support and wherein said control element is able to rotate after having been so mounted.

6. The apparatus of claim 1, wherein said control element is mounted on said rotary support.

7. The apparatus of claim 1, wherein a shaft guide of said first motor extends inside said inner space and wherein said inner space is enclosed by said top support.

8. The apparatus of claim 1, wherein said top support comprises vertical support braces that are arranged around said machine axis and that are parallel to said machine axis.

9. The apparatus of claim 1, further comprising a runner that extends along an upper side of said rotatable capping tools, wherein said runner runs along said control link.

10. The apparatus of claim 1, further comprising a screw flange, wherein said screw flange connects said bottom support to said middle support at a location that is beneath said rotary support, said location being separated from said rotary support by between five centimeters and thirty centimeters.

11. The apparatus of claim 1, further comprising a screw flange, wherein said screw flange connects said bottom support to said middle support at a location that is beneath said rotary support, said location being separated from said rotary support by no more than forty centimeters.

12. The apparatus of claim 1, wherein said bottom support element is a column that has a polygonal cross section and wherein said column is concentric with said machine axis.

13. The apparatus of claim 1, wherein a motor selected from the group consisting of said first and second motors is secured to said head plate, wherein said motor's shaft guide extends vertically downward toward said respective drive-gear wheel along a direction parallel to said machine axis.

14. The apparatus of claim 13, wherein said shaft guide extends into a ring-shaped region between said top support and said capping arrangements.

15. The apparatus of claim 13, wherein said second drive-gear wheel extends into a ring-shaped region between said top support and said capping arrangements.

16. The apparatus of claim 1, further comprising a shaft guide that extends parallel to said machine axis and projects as far as said middle support, said shaft guide being a shaft guide of one of said first and second motors.

17. The apparatus of claim 1, wherein said control element is mounted at said rotary support and wherein said control element is able to rotate independently of said rotary support after having been so mounted.

18. The apparatus of claim 1, wherein said capping machine is configured to be dismantled from above starting with said head plate.

19. The apparatus of claim 1, wherein said second crown-gear wheel carries an inner crown gear on a radially-outward surface thereof and wherein said second drive-gear wheel engages said inner crown gear.

20. The apparatus of claim 1, wherein said carries an outer crown gear on a radially-outer surface thereof and wherein said second drive-gear wheel engages said outer crown gear.

* * * * *